US009437932B1

(12) United States Patent
Freeman et al.

(10) Patent No.: US 9,437,932 B1
(45) Date of Patent: Sep. 6, 2016

(54) TWO-ARM DELTA MODE SPIRAL ANTENNA

(75) Inventors: Will Freeman, Ridgecrest, CA (US); Michael M. Neel, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 225 days.

(21) Appl. No.: 13/594,574

(22) Filed: Aug. 24, 2012

Related U.S. Application Data

(60) Provisional application No. 61/532,657, filed on Sep. 9, 2011.

(51) Int. Cl.
*H01Q 9/27* (2006.01)
*H01Q 1/28* (2006.01)

(52) U.S. Cl.
CPC . *H01Q 9/27* (2013.01); *H01Q 1/28* (2013.01)

(58) Field of Classification Search
CPC ..... H01Q 9/28; H01Q 9/30; H01Q 11/08; H01Q 1/362; H01Q 9/27
USPC ..... 343/790, 895
See application file for complete search history.

(56) References Cited

U.S. PATENT DOCUMENTS 3,192,531 A * 6/1965 Cox et al. ..... 343/895
3,555,554 A * 1/1971 Kuo ..... 343/895
3,717,878 A 2/1973 Mosko et al.
4,309,706 A * 1/1982 Mosko ..... 342/359
4,315,266 A * 2/1982 Frosch et al. ..... 343/895
4,387,379 A * 6/1983 Hardie ..... H01Q 9/27 343/895
4,525,720 A 6/1985 Corzine et al.
4,823,145 A * 4/1989 Mayes et al. ..... 343/895
5,053,786 A * 10/1991 Silverman et al. ..... 343/895
6,201,513 B1 * 3/2001 Ow et al. ..... 343/895
6,266,027 B1 * 7/2001 Neel ..... 343/895
6,975,281 B2 12/2005 Neel
7,692,603 B1 4/2010 Cencich, Sr. et al.
2010/0066624 A1 * 3/2010 Masuda et al. ..... 343/787
2010/0271267 A1 * 10/2010 Roth et al. ..... 343/700 MS

OTHER PUBLICATIONS

Will Freeman, Scot Rogala, Mike Neel, "Short Reflector Cavity Backed Spiral Antennas," NAWCWD TM 8583, Sep. 2008, DoD, China Lake, CA.
Joseph A. Mosko, "An Introduction to Wideband, Two-Channel, Direction-Finding Systems: Part II," Microwave Journal, Mar. 1984, pp. 105-122.
Joseph A. Mosko, "An Introduction to Wideband, Two-Channel Direction-Finding Systems: Part I: General System Overview, Radiator, and Arithmetic Subsystems," Microwave Journal.

* cited by examiner

*Primary Examiner* — Sue A Purvis
*Assistant Examiner* — Daniel J Munoz
(74) *Attorney, Agent, or Firm* — James M. Saunders

(57) ABSTRACT

A two-arm delta mode spiral antenna includes a dielectric substrate having an upper side, a lower side, and an outward edge. A flat top cone with cylinder sidewall is attached to the lower side of the dielectric substrate, forming a scalable feed cavity. Two spiraling conductive radiator arms are mounted on the dielectric substrate. A magic-T is electrically connected to the two spiraling conductive radiator arms.

6 Claims, 3 Drawing Sheets

TWO-ARM DELTA MODE SPIRAL ANTENNA

CROSS-REFERENCE TO RELATED APPLICATIONS

This is a non-provisional application claiming the benefit of parent provisional application No. 61/532,657 filed on Sep. 9, 2011, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to antennas, and more particularly, to two-arm spiral antennas capable of forming Δ mode (mode 2) patterns for direction-finding, that are improved compared to previous two-arm spiral Δ mode patterns. Δ mode patterns are obtained using a two-arm radiator antenna with a scalable feed cavity and a very simple feed network. The antenna also generates Σ mode (mode 1) patterns.

Figure 1A:
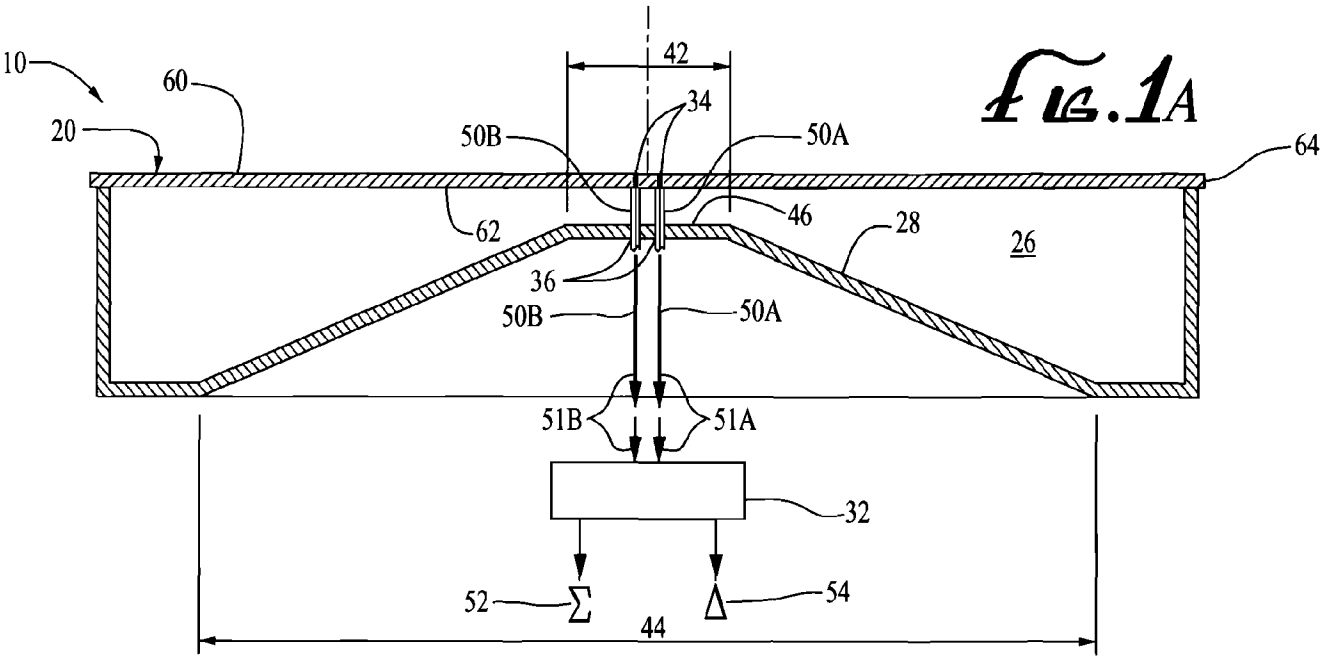
FIG. 1A illustrates a partial section view of a two-arm Δ mode spiral antenna with a schematically illustrated magic-T, according to embodiments of the invention.
Figure 1B:
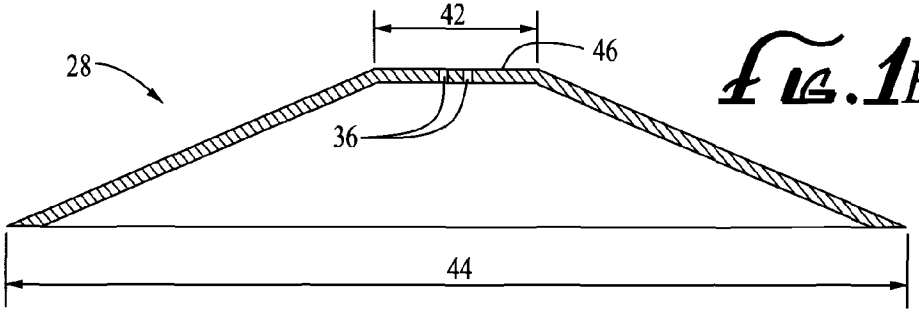
FIG. 1B illustrates a section view of a flat top cone (without a cylinder sidewall), according to embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

The invention generally relates to antennas, and more particularly, to two-arm spiral antennas capable of forming Δ mode (mode 2) patterns for direction-finding, that are improved compared to previous two-arm spiral Δ mode patterns. Δ mode patterns are obtained using a two-arm radiator antenna with a scalable feed cavity and a very simple feed network. The antenna also generates Σ mode (mode 1) patterns.

It is well known that N-arm spiral antennas have N−1 balanced modes. It is for this reason that wideband direction-finding spiral antennas, that require forming both the Σ and Δ modes, have used more than two arms. Due to symmetry reasons, the four-arm spiral antenna has traditionally been favored and is capable of forming balanced Σ and Δ modes, but does require using a somewhat complicated mode former includes several couplers. The invention describes a two-arm spiral antenna with a scalable feed cavity employing an inner flat top cone capable of forming the usual Σ patterns as well as useable Δ mode patterns even though this mode may not be truly balanced. The feed network or mode former is much simpler requiring only a single magic-T. Useable Δ mode patterns are generated over much broader bandwidths than are possible using traditional two-arm spiral antennas, where generally the imbalanced Δ mode patterns are not useable.

The Σ and Δ mode patterns can be utilized in the usual ways for direction-finding, for either polar coordinate direction-finding using the amplitude difference of the E and A mode patterns to find θ and the phase difference of the Σ and Δ modes to find ϕ, or through the use of a beam former. It is understood that phase rotation compensation is taken into account. Likewise, it is understood that θ is the plane perpendicular to the plane of the antenna circuit board and ϕ is the plane parallel to the plane of the antenna circuit board, respectively. These antennas are useful for circularly polarized broadband direction-finding antenna applications.

Although embodiments of the invention are described in considerable detail, including references to certain versions thereof, one skilled in the art would recognize that other versions are possible such as, for example, other versions of the filament arms (spiraling conductive radiator arms). Examples of other versions include, but are not limited to, using Archimedian, logarithmic, variable growth rate, hyperbolic, or other spiraling conductive radiator arms. Similarly, any number of turns of the spiraling conductive radiator arms is possible. Therefore, the spirit and scope of the appended claims should not be limited to the description of versions described herein.

Figure 2:
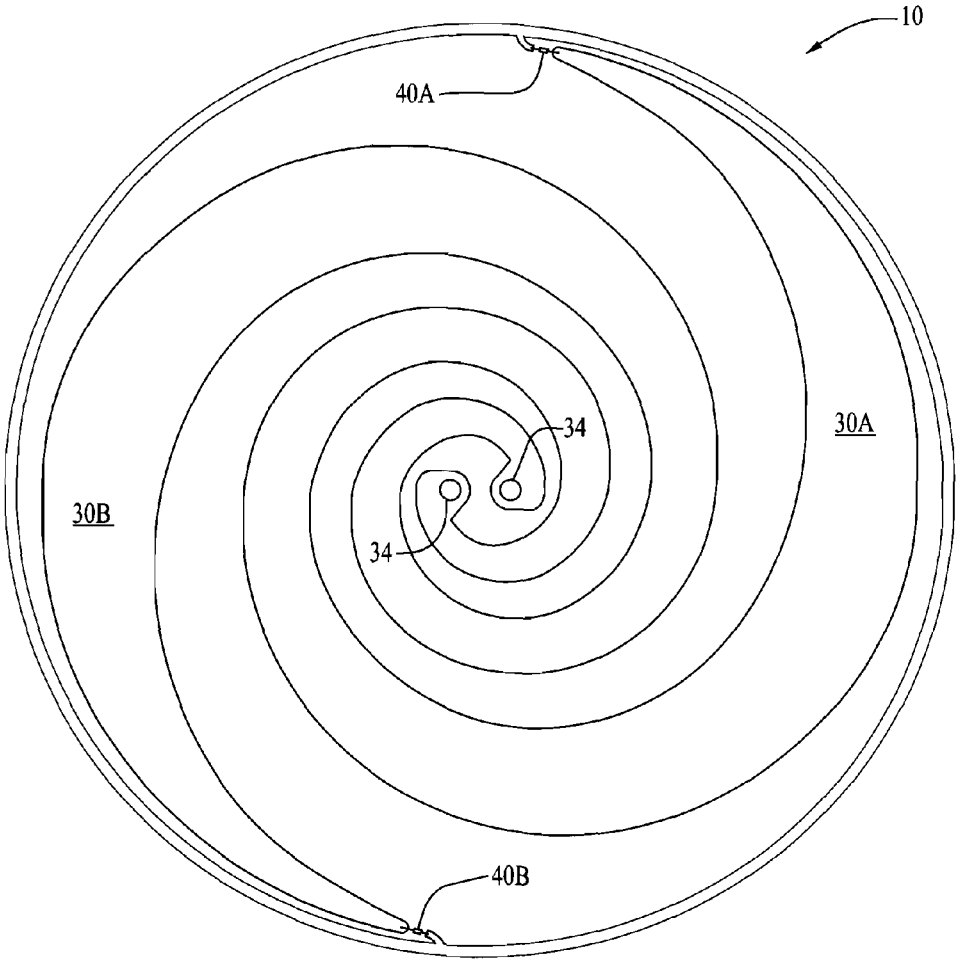
FIG. 2 illustrates a top plan view of a two-arm Δ mode spiral antenna, according to embodiments of the invention, which illustrates one way (of the many possible) of resistively terminating spiraling conductive radiator arms.

In the accompanying drawings, like reference numbers indicate like elements. Referring simultaneously to FIGS. 1A and 2, reference character 10 generally indicates an apparatus of embodiments of the invention. FIG. 1A illustrates a partial section view of a two-arm delta mode spiral antenna with a schematically illustrated magic-T, according to embodiments of the invention. FIG. 2 illustrates a top plan view of a two-arm delta mode spiral antenna, according to embodiments of the invention, which illustrates one way (of the many possible) of resistively terminating the spiraling conductive radiator arms.

Embodiments of the invention generally relate to an antenna including: a dielectric substrate 20 having an upper side 60, a lower side 62, and an outward edge 64. A flat top cone with cylinder sidewall 28 (shown in FIG. 1A) is attached to the lower side 62 of the dielectric substrate 20. A void space 26 is defined by the lower side 62 of the dielectric substrate 20 and the flat top cone with cylinder sidewall 28. The void space 26 is a scalable feed cavity and can be filled with an electromagnetic energy absorbing material depending on application-specific parameters.

Two spiraling conductive radiator arms 30A and 30B are mounted on the dielectric substrate 20. As depicted in FIG. 1A, a magic-T 32 is electrically connected to the two spiraling conductive radiator arms 30A and 30B. A person having ordinary skill in the art will recognize that the two spiraling conductive radiator arms 30A and 30B may also be referred to as radiation filaments or filament arms.

A person having ordinary skill in the art will recognize that the dielectric substrate 20 may also be referred to as a circuit board. A first opening pair 34 extends through the center of the dielectric substrate 20. A second opening pair 36 extends through the center of the flat top cone with cylinder sidewall 28. Each of the two spiraling conductive radiator arms 30A and 30B originate from each respective opening of the first opening pair 34 in the center of the dielectric substrate 20. The two spiraling conductive radiator arms 30A and 30B receive electromagnetic energy. The two spiraling conductive radiator arms 30A and 30B can also radiate electromagnetic energy.

The two spiraling conductive radiator arms 30A and 30B are resistively terminated on opposing edges of the dielectric substrate 20. One of the two spiraling conductive radiator arms 30A terminates at a first resistor 40A and the other of the two spiraling conductive radiator arms 30B terminates at a second resistor 40B. The first resistor 40A and the second resistor 40B are mounted on opposing edges of the dielectric substrate 20. The resistors 40A and 40B are mounted 180 degrees apart from each other. Each of the resistors 40A and 40B prevent reflection of electromagnetic energy back toward the center of the dielectric substrate 20. A person having ordinary skill in the art will recognize that other appropriate resistive termination techniques are possible without loss of generality or detracting from the merits of the invention.

The flat top cone with cylinder sidewall 28 is electrically conductive and has a predetermined upper diameter 42, a predetermined lower diameter 44, and a flat upper portion 46. The flat upper portion 46 is a predetermined depth below the lower side 62 of the dielectric substrate 20, based on application-specific requirements.

The magic-T 32 is a signal combiner. Ports are schematically shown in FIG. 1A. The magic-T 32 has two input ports 51A and 51B and two output ports 52 and 54 (Σ and Δ ports). The two input ports 51A and 51B are referred to as a first and second input port, respectively. Similarly, the two output ports 52 and 54 are referred to as a first and second output port, respectively. The first output port 52 is a sum port and the second output port 54 is a delta port. The first and second output ports 52 and 54 provide combined in-phase (Σ) and out-of-phase (Δ) signals.

A first 50A and a second 50B feed line are a first and a second coaxial transmission line. The first coaxial transmission line 50A connects the first output port 52 to one of the two spiraling conductive radiator arms 30A through one opening in each of the first opening pair 34 and the second opening pair 36. The second coaxial transmission line 50B connects the second output port 54 to the other of the two spiraling conductive radiator arms 30B through the other opening in each of the first opening pair 34 and the second opening pair 36.

In another embodiment, the invention generally relates to an antenna including: a dielectric substrate 20 having an upper side 60, a lower side 62, and an outward edge 64. Two spiraling conductive radiator arms 30A and 30B are mounted on the upper side 60 of the dielectric substrate 20. The two spiraling conductive radiator arms 30A and 30B originate from the center of the dielectric substrate 20. The two spiraling conductive radiator arms 30A and 30B may also be mounted on the lower side 62 of the dielectric substrate 20. The two spiraling conductive radiator arms 30A and 30B receive electromagnetic energy. The two spiraling conductive radiator arms 30A and 30B can also radiate electromagnetic energy.

A flat top cone with cylinder sidewall 28 is attached to the lower side 62 of the dielectric substrate 20. A magic-T feed network 32 is electrically connected with the two spiraling conductive radiator arms 30A and 30B. The feed network is adapted to combine power signals and transmit the combined power signals to each of the two spiraling conductive radiator arms 30A and 30B.

A first opening pair 34 extends through the center of the dielectric substrate 20. A second opening pair 36 extends through the center of the flat top cone with cylinder sidewall 28. The two spiraling conductive radiator arms 30A and 30B are resistively terminated on opposing edges of the dielectric substrate 20 at resistors 40A and 40B, respectively. The flat top cone with cylinder sidewall 28 has a predetermined upper diameter 42, a predetermined lower diameter 44, and a flat upper portion 46. The flat upper portion 46 is a predetermined depth below the lower side 62 of the dielectric substrate 20, based on application-specific requirements.

The feed network includes a magic-T 32 having a first and a second input port 51A and 51B and a first and a second output port (Σ and Δ ports) 52 and 54, and a first 50A and second 50B feed line. The first and second output ports 52 and 54 provide the input ports 51A and 51B combined in-phase (Σ) and out-of-phase (Δ) signals. The apparatus 10 outputs Σ mode and Δ mode from the first and second output ports, 52 and 54, respectively, as shown in FIG. 1A.

The first feed line 50A is a first coaxial transmission line connecting the first output port 52 of the magic-T 32 to one of the two spiraling conductive radiator arms 30A through one opening in each of the first opening pair 34 and the second opening pair 36. The second feed line 50B is a second coaxial transmission line connecting the second output port 54 to the other of the two spiraling conductive radiator arms 30B through the other opening in each of the first opening pair 34 and the second opening pair 36.

Each of the two spiraling conductive radiator arms 30A and 30B originate from each respective opening of the first opening pair 34 in the dielectric substrate 20. The flat top cone with cylinder sidewall 28 is made from an electrically conductive material. Any material having appropriate electrical conductivity may be used.

In yet another embodiment, the invention generally relates to an antenna including: a dielectric substrate 20 having an upper side 60, a lower side 62, and an outward edge 64. Two spiraling conductive radiator arms 30A and 30B are mounted on the dielectric substrate 20. The two spiraling conductive radiator arms 30A and 30B originate from the center of the dielectric substrate 20. The two spiraling conductive radiator arms 30A and 30B receive electromagnetic energy. The two spiraling conductive radiator arms 30A and 30B can also radiate electromagnetic energy.

A flat top cone with cylinder sidewall 28 is attached to the lower side 62 of the dielectric substrate 20. A magic-T 32 is electrically connected with the two spiraling conductive radiator arms 30A and 30B by a stripline feed. The magic-T is adapted to combine power signals and transmit the combined power signals to each of the two spiraling conductive radiator arms 30A and 30B.

The two spiraling conductive radiator arms 30A and 30B are resistively terminated on opposing edges of the dielectric substrate 20. The flat top cone with cylinder sidewall 28 is electrically conductive and has a predetermined upper diameter 42, a predetermined lower diameter 44, and a flat upper portion 46. The flat upper portion 46 is a predetermined depth below the lower side 62 of the dielectric substrate 20, based on application-specific requirements.

The scalable feed cavity 26 is defined by the cavity depth under which the radiating modal current of interest predominantly resides, wherein the ratio $d_c(\lambda)/\lambda$ is approximately constant (described here from a transmitting point of view for greater clarity). In embodiments. "approximately" means that the cavity depth at high frequencies divided by the corresponding wavelengths at high frequencies is approximately the same as cavity depths at low frequencies divided by corresponding wavelengths at low frequencies.

The magic-T 32 has a first and a second input port 51A and 51B and a first and a second output port (Σ and Δ ports) 52 and 54. The first and second output ports 52 and 54 provide the input ports 51A and 51B combined in-phase (Σ) and out-of-phase (Δ) signals.

One of the strips of the stripline feed connects the first output port 52 to one of the two spiraling conductive radiator arms 30A. The other strip of the stripline feed connects the second output port 54 to the other of the two spiraling conductive radiator arms 30B. The apparatus 10 outputs Σ mode and Δ mode from the first and second output ports, 52 and 54, respectively, as shown in FIG. 1A.

Figure 3:
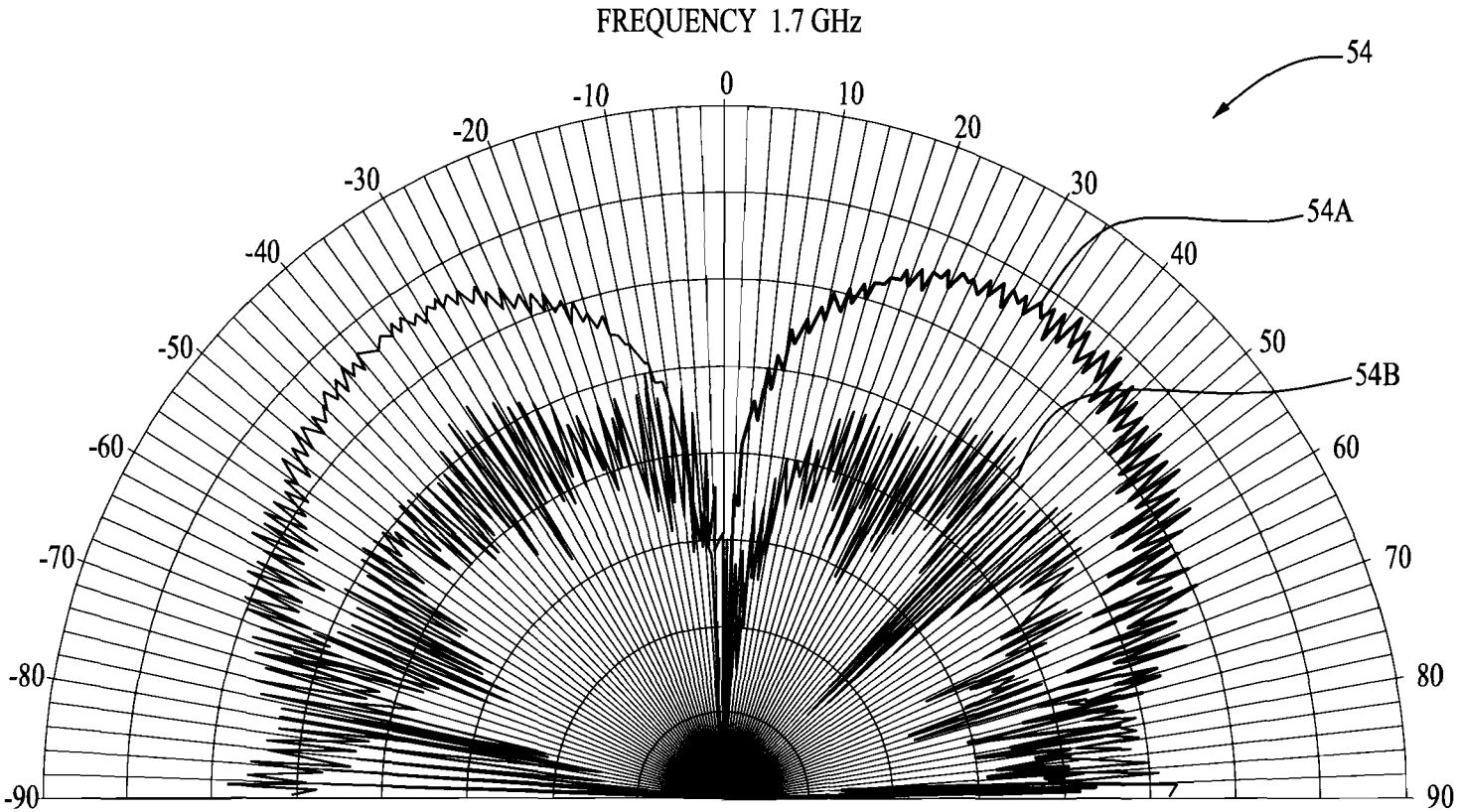
FIG. 3 illustrates a delta mode pattern from a two-arm Δ mode spiral antenna with a scalable feed cavity, according to embodiments of the invention, compared to a Δ mode pattern from a conventional two-arm spiral antenna without a scalable feed cavity.

FIG. 3 illustrates a Δ mode pattern from a two-arm delta mode spiral antenna with a scalable feed cavity, according to embodiments of the invention, compared to a Δ mode pattern from a conventional two-arm spiral antenna without a sealable feed cavity.

A Δ mode pattern from an apparatus having a scalable feed cavity is shown as reference character 54A. A Δ mode pattern from an apparatus without a scalable feed cavity is shown as reference character 54B. A comparison of the two patterns reveals that the Δ mode pattern 54A from an apparatus having the scalable feed cavity is much less distorted. Additionally, the Δ mode pattern 54A from an apparatus having the scalable feed cavity exhibits higher gain and better axial ratio than the Δ mode pattern 54B from an apparatus without a scalable feed cavity.

It will be recognized that apparatus components are appropriately-sized and selected based on application-specific operating wavelength. Further research includes identifying other appropriate geometric shapes for the flat top cone with cylinder sidewall 28 including, but not limited to, cylindrically-shaped devices having flat upper portions.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An unbalanced antenna, comprising:

a dielectric substrate having an upper side, a lower side, and an outward edge; a first and a second spiraling conductive radiator arm mounted on said dielectric substrate, wherein said first and second spiraling conductive radiator arms originate from the center of said dielectric substrate, wherein said first and second spiraling conductive radiator arms are resistively terminated, wherein each of said first and second spiraling conductive radiator arms are mounted on said lower side of said dielectric substrate;

a single component flat top cone with cylinder sidewall, said single component flat top cone with cylinder sidewall having one single flat upper portion parallel with said dielectric substrate, said single flat upper portion transitioning to a single flat lower portion parallel with said dielectric substrate, said single flat lower portion transitioning to said cylinder sidewall, said cylinder sidewall having an outer surface, said cylinder sidewall of said single component flat top cone is attached to said lower side of said dielectric substrate wherein said outer surface of said cylinder sidewall is not vertically aligned with said outward edge of said dielectric substrate, said attachment forming a scalable feed cavity proximate said lower side of said dielectric substrate and defined by said single component flat top cone with cylinder sidewall, said single component flat top cone with cylinder sidewall having a substantially-uniform cross-sectional thickness, wherein said single component flat top cone is hollow; and a magic-T signal combiner electrically connected with said first and second spiraling conductive radiator arms by a coaxial stripline feed comprising two coaxial transmission lines, wherein said magic-T signal combiner is configured to combine power signals and transmit said combined power signals to each of said first and second spiraling conductive radiator arms, wherein each of said coaxial transmission lines is connected to only one of spiraling conductive radiator arms.

2. The antenna according to claim 1, wherein said single component flat top cone with cylinder sidewall comprises an electrically conductive cone having a predetermined upper diameter and a predetermined lower diameter, wherein said predetermined lower diameter is greater than said predetermined upper diameter.

3. The antenna according to claim 1, wherein a scalable feed cavity is defined by the cavity depth under which the radiating modal current of interest predominantly resides, wherein the ratio $d_c(\lambda)/\lambda$ is approximately constant.

4. The antenna according to claim 1, wherein said magic-T signal combiner comprises a first and a second input port and a first and a second output port, wherein said first and second output ports provide combined in-phase and out-of-phase signals, wherein one of the strips of said stripline feed connects said first output port to said first spiraling conductive radiator arm, wherein the other strip of said stripline feed connects said second output port to said second spiraling conductive radiator arm.

5. The antenna according to claim 1, wherein said scalable feed cavity is a void.

6. The antenna according to claim 1, wherein said scalable feed cavity is filled with an electromagnetic absorbing material.

* * * * *